United States Patent [19]

Cryder et al.

[11] 4,167,892

[45] Sep. 18, 1979

[54] LOAD CHECK WITH MECHANICAL VENTING MEANS

[75] Inventors: John R. Cryder; Gerald D. Hall, both of Joliet; Samuel G. Dunlap, Jr., Goodfield, all of Ill.

[73] Assignee: Caterpillar Tractor Co., Peoria, Ill.

[21] Appl. No.: 785,627

[22] Filed: Apr. 7, 1977

[51] Int. Cl.[2] ..... F15B 11/08; F15B 13/042

[52] U.S. Cl. ..... 91/445; 91/447; 137/596.2

[58] Field of Search ..... 91/445, 447; 137/596.2

[56] References Cited

U.S. PATENT DOCUMENTS

| | | | |
|---|---|---|---|
| 1,420,256 | 6/1922 | Hammond, Jr. | 91/465 X |
| 2,572,705 | 10/1951 | Edman | 137/636.1 |
| 3,049,101 | 8/1962 | Ruhl | 91/447 X |
| 3,127,688 | 4/1964 | Hein et al. | 91/445 X |
| 3,216,448 | 11/1965 | Stacey | 137/596.2 |
| 3,274,902 | 9/1966 | Kleckner | 137/596.2 X |
| 3,523,490 | 8/1970 | Bianchetta | 91/420 |
| 3,788,401 | 1/1974 | Scheidt et al. | 91/445 X |
| 3,795,255 | 3/1974 | Malott et al. | 91/420 X |
| 3,800,670 | 4/1974 | Hufeld et al. | 91/420 |
| 3,908,515 | 9/1975 | Johnson | 91/445 X |
| 4,006,667 | 2/1977 | Bianchetta et al. | 91/445 |
| 4,018,350 | 4/1977 | Brown | 91/447 X |

*Primary Examiner*—Irwin C. Cohen

*Attorney, Agent, or Firm*—Phillips, Moore, Weissenberger, Lempio & Majestic

[57] ABSTRACT

A hydraulic motor and control system therefor which includes a pump for delivering fluid to a control valve, the control valve having a Float position which connects a first end of the motor to a sump, a First position for applying fluid from the pump to power the motor in a first direction by delivering fluid to the first end of the motor via a flow path and a Second position in which the motor moves in a second and opposite direction. A conduit connects the control valve to the sump. A check valve is provided in the flow path which always allows flow therethrough towards the first end of the motor and normally blocks reverse flow therethrough and also a mechanism for opening the check valve to allow reverse flow therethrough responsive to operation of the control valve in the Float position and in the Second position.

7 Claims, 2 Drawing Figures

R
N
L
F

LOAD CHECK WITH MECHANICAL VENTING MEANS

BACKGROUND OF THE INVENTION

1. Field of the Invention

The invention is concerned with a hydraulic motor and control system therefor and more particularly with improvements in the control system which allow the hydraulic motor to operate in any of a Float, a First position providing power in a first direction (e.g., a Raise position) or a Second position providing power in a second direction (e.g., a Lower position). Generally the system will also allow the hydraulic motor to operate in a Neutral (Hold) position. Such a control system is particularly advantageous when used with various types of earth working equipment such as, for example, a front loading loader, a dozer, a lift piston of a tractor-scraper and the like.

2. Prior Art

Control valves for hydraulic motors are known which provide Float, Neutral, Raise (first direction power) and Lower (second direction power) position. Further, a particular safety problem exists with prior art hydraulic motor control systems, which problem is that the pressure from the pump to the hydraulic motor of such a system may be suddenly cut off during Raise or Neutral operation due to breakage of the line therebetween, failure of the pump, or failure of the engine driving the pump. In such an instance and particularly when line breakage occurs, if the hydraulic motor is holding a load, e.g., in a raised position, the load can fall very quickly under the influence of gravity thus causing potentially great harm to the load itself and to the equipment.

The present invention provides a particular control system-hydraulic motor combination which eliminates this problem of a fast falling load but at the same time retains each of the Float, Neutral, Lower and Raise positions of operation for the control system and which further operates solely by mechanical means thus providing quick and positive action and shifting between the Float position, the Neutral position, the Raise position, and the Lower position.

SUMMARY OF THE INVENTION

The present invention is directed to overcoming one or more of the problems as set forth above.

The invention is concerned with an improvement in a hydraulic motor and a control system therefor of the type which includes fluid source means for delivering fluid from sump means via first conduit means to control valve means having a Float position wherein a first end of the motor is in flow communication with a second end thereof and with the sump means; a First position for applying fluid from the fluid source means to power the motor to move in a first direction by delivering the fluid to the first end thereof via second conduit means; and a Second position in which the motor moves in a second direction; sump conduit means communicating the control valve means with the sump means and check valve means in the second conduit means allowing fluid flow therethrough to the first end of the motor and normally blocking reverse flow therethrough said check valve means including control chamber means which when blocked from said sump means maintains said reverse flow blocking and when in flow communication with said sump means permits said reverse flow; and drain conduit means connecting said control chamber means with said sump means. The improvement of the present invention comprises drain valve means in the drain conduit means having a first position communicating the drain conduit means to the sump means and a second position blocking that communication; means biasing the drain valve means into the first position thereof; bellcrank means linked by first linking means at a first arm thereof to the control valve means, linked via second linking means at a second arm thereof to the drain valve means and pivoted to frame means intermediate the first and second arms thereof, the second linking means comprising a mouth formed by the second arm of the bellcrank means; a member pivotally mounted to the frame means at an area thereof spaced latitudinally from the mouth, a first portion of the member extending into contact with the mouth in position to move responsive to movement of the mouth responsive to rotation of the bellcrank means, a second portion of the member contacting the drain valve means to overcome the biasing means and shift the drain valve means into the second position thereof responsive to rotation of the bellcrank means; and biasing means acting intermediate the frame means and the member to bias the member to maintain contact with the mouth and with the drain valve means.

BRIEF DESCRIPTION OF THE DRAWING

The invention will be better understood by reference to the figures of the drawing wherein like numbers denote like parts throughout and wherein.

DETAILED DESCRIPTION OF THE PREFERRED EMBODIMENT

Figures 1, 2:
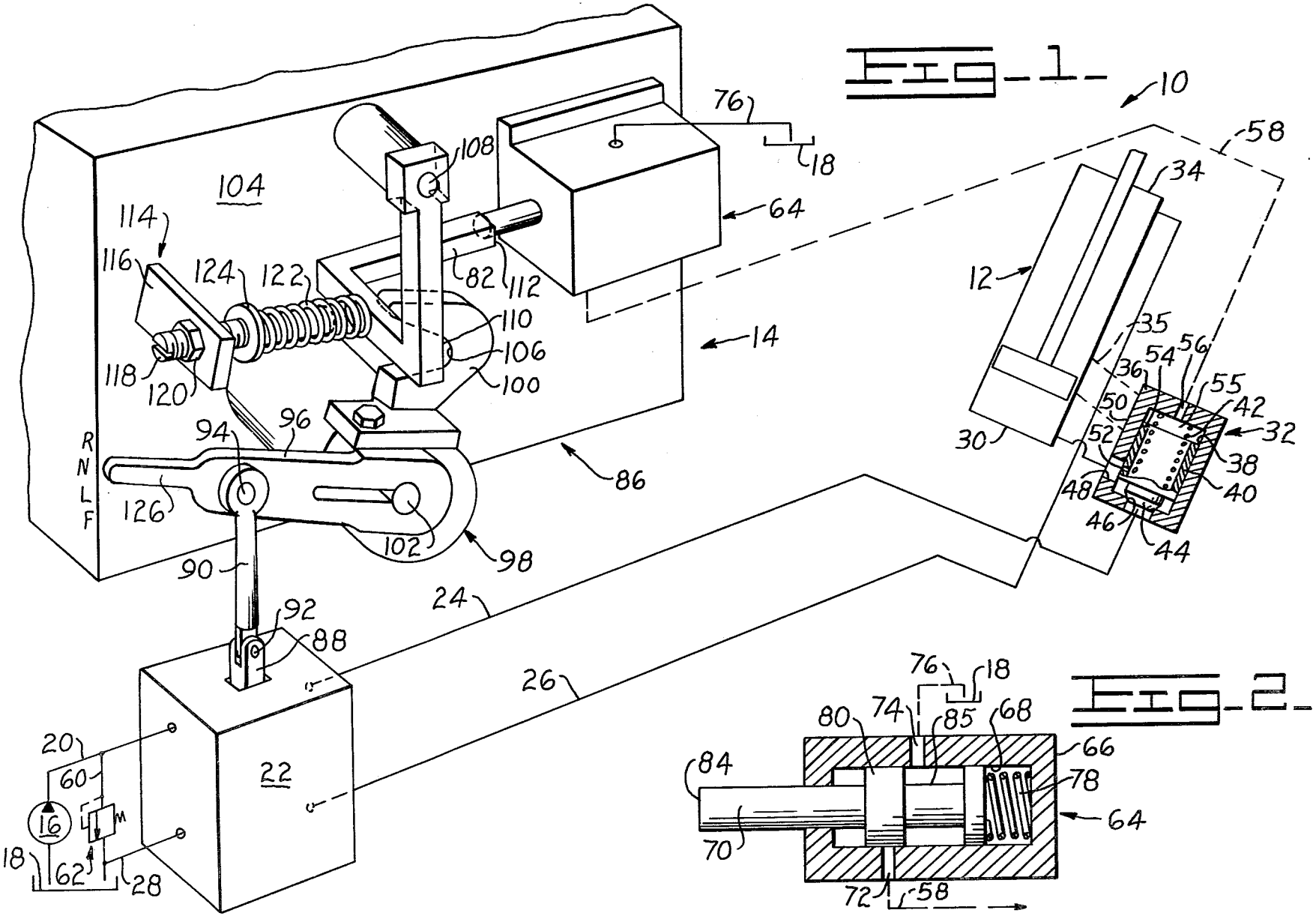
FIG. 1 illustrates, partially in perspective, partially schematically and partially in section, a hydraulic motor and control system therefor, including the improvement of the present invention.
FIG. 2 illustrates in side section a detail in the structure shown in FIG. 1.

While the following description is directed particularly to a system which includes a hydraulic motor arranged to raise and lower loads it is to be understood that the present invention equally relates to horizontal motors and that, hence, the terms Raise and Lower as used herein are merely illustrative of the broader terms "power in a first direction" and "power in a second direction", respectively. Also, while the following description is of a double acting motor the system described is equally applicable to single acting motors as, for example, lift truck mast extension cylinders and the like.

Referring first to FIG. 1, there is illustrated therein a hydraulic motor-control system 10, which includes a hydraulic motor 12 along with a control system 14. The control system 14 includes a pump 16 which pumps fluid from a sump 18 via a first conduit 20 through a control valve 22. The control valve 22 is of a conventional type which will direct fluid flow from the first conduit 20 either to a second conduit 24 or to a third conduit 26. The control valve 22 has internal connections which provide a Float position in which the first conduit 20, the second conduit 24 and the third conduit 26 communicate with a fourth or sump conduit 28, which conduit 28 communicates with a sump 18. The control valve 22 further provides a Neutral position in which the second conduit 24 and the third conduit 26 are isolated by the control valve 22 from the sump 18, and a first conduit 20 communicates via the control valve 22 with the sump 18. The control valve 22 also provides a Raise position in which the third conduit 26 communicates via the control valve 22 with the fourth conduit 28 and the first conduit 20 communicates via the control valve 22 with the second conduit 24. In addition, the control valve 22 conventionally provides internal connections which provide a Lower position in which the second conduit 24 communicates via the control valve 22 with the fourth conduit 28 and the first conduit 20 communicates via the control valve 22 with the third conduit 26. It should be noted that the present invention is not concerned with any improvement in the control valve 22 per se but instead is concerned with an overall improvement in the control system 14 which operates the hydraulic motor 12, and which allows the conventional control valve 22 to operate in each of its four positions while still solving the problem of fast dropping loads in cases of hydraulic line breakage.

The second conduit 24 communicates with a first end 30 (preferably the head end to provide maximum force on load raising) of the hydraulic motor 12. A check valve 32 is in the second conduit 24 and is raised to allow fluid flow therethrough due to the pressure of said fluid flow when the control valve 22 is in the Raise position (when fluid is being pumped towards the first end 30 of the hydraulic motor 12). The check valve 32 normally blocks fluid flow therethrough when the control valve 22 is in the Lower position (when fluid is flowing out of the first end 30 of the hydraulic motor 12) and in the Float position (when the first end 30 of the hydraulic motor 12, and, in a double action motor a second end 34 thereof also, communicates with the sump 18) but is openable as explained below by creating a pressure drop thereacross to allow flow out of the first end 30 of the hydraulic motor 12 in said Lower and Float positions. The check valve 32 can be directly mounted to the motor 12 as indicated schematically by dashed lines 35 to minimize or even eliminate the length of the second conduit 24 between the check valve 32 and the motor 12 thus minimizing or eliminating the possibility of breakage of this line. The check valve 32 comprises a check valve body 36 having a bore 38 therewithin in which a sleeve-piston 40 slidingly fits as biased by a spring 42 with a closed end 44 of the sleeve-piston 40 being biased by the spring 42 to sit against a seat 46 of the check valve body 38. When pressure from the pump 16 is being passed from the first conduit 20 via the control valve 22 to the second conduit 24, this pressure then applies against the closed end 44 of the sleeve-piston 40 forcing it to leave the seat 46 by overcoming the biasing of the spring 42 whereby fluid flow proceeds through a port 48 in a side 50 of the check valve body 36 and thence via a continuation of the second conduit 24 to the first end 30 of the hydraulic motor 12. When fluid is flowing out of the first end 30 of the hydraulic motor 12, it flows via the continuation of the second conduit 24 through the port 48 into a flow restriction hole 52 in a side 54 of the sleeve piston 40, which hole 52 passes latitudinally through said side 54 to a central bore 55 of the sleeve-piston 40 which along with the bore 38 forms control chamber means for the check valve 32 and thence via an egress 56 from the check valve bore 38. From the egress 56 a restricted amount of the hydraulic fluid leaving the first end 30 of the hydraulic motor 12 then passes via a drain conduit 58 from whence it can be directed to a sump 18 in the Lower and Float modes in a manner which will be explained in the following. Meanwhile, the full pressure in the first end 30 of the hydraulic motor 12 is applied against a portion of the closed end 44 (first end) of the sleeve-piston 40 via the port 48. Due to the pressure differential thus created the closed end 44 of the sleeve-piston 40 lifts off of the seat 46 and flow can proceed back towards the control valve 22 and on to the sump 18. Flow to and from the second end 34 of the hydraulic motor 12 proceeds via the control valve 22 and the fourth conduit 28 under the normal mode of operation for the control valve 22.

A sixth or relief conduit 60 provides a path to drain from the first conduit 20 via a pressure relief valve 62 in the Raise and Lower positions so as to provide regulation of the maximum pressure developable in the first conduit 20 and hence in the first end 30 and the second end 34 of the hydraulic motor 12.

A drain valve 64 illustrated most clearly in FIG. 2 is located in the fifth or drain conduit 58 between the check valve 32 and the sump 18. The drain valve 64 has a first position at which it communicates the fifth conduit 58 with sump 18 and a second position wherein it blocks communication of the fifth conduit 58 with the sump 18. Briefly and as shown in FIG. 2, the drain valve 64 includes a valve body 66 with a bore 68 therein. A spool 70 slidingly fits within the drain bore 68 of the drain valve body 66. The drain valve 64 provide interconnection between an entry port 72 thereof and an exit port 74 thereof. The drain valve 64 also blocks interconnection between the entry port 72 and the exit port 74 in the aforementioned second position thereof. If the entry port 72 and exit port 74 are interconnected via the drain valve 64, then the restricted flow of fluid passes through a seventh conduit 76 and thence to the sump 18. A spring 78 serves to bias the spool 70 into a respective one of the first and second positions. In the embodiment illustrated in FIGS. 1 and 2, the control valve 22 is in the Neutral position and the spring 78 biases the drain spool 70 into its second position wherein the entry port 72 is blocked off from the exit port 74, by the action of a member 82 in FIG. 1 which acts against an outer end 84 of the drain spool 70 to hold the drain spool 70 in the second position. When the drain spool 70 is shifted into its first position, as by removing the force exerted by the member 82 upon the outer end 84 of the drain spool 70, fluid passes from the entry port 72 about an undercut 85 of the spool 70 and thence to the exit port 74.

Mechanical means 86 as shown most clearly in FIG. 1 include as a part thereof the aforementioned member 82. The mechanical means 86 moves responsive to movement of a control spool 88 of the control valve 22. The mechanical coupling means 86 serves to shift the drain spool 70 of the drain valve 64 into the second position thereof when the control spool 88 is in the Raise and Neutral positions. When the control spool 88 is in the Lower and Float positions, the spring 78 forces the drain spool 70 leftwardly into the first position thus allowing flow as previously mentioned from the entry port 72 to the exit port 74 and thence to the sump 18 whereby the check valve 32 is opened. Thus, a drain path is provided through the drain valve 64 whenever the control valve 22, or more specifically, the control spool 88 thereof is shifted to either of the Lower or the Float positions. Also, the drain valve 64 blocks flow through the fifth conduit 58 whenever the control valve 22, or more specifically the control spool 88 thereof is shifted into either of the Neutral or the Raise positions.

Turning most particularly to the preferred structure of the mechanical coupling 86, it will be seen that a link 90 is pivotally interconnected to the control spool 88 at a pivot 92 and is likewise connected at a pivot 94 to a first arm 96 of a bellcrank 98 whereby the link 90 serves as first linking means linking the bellcrank 98 to the control spool 88. Second linking means which are linked to a second arm 100 of the bellcrank 98 serve to link the drain spool 70 to the second arm 100 of the bellcrank 98. The bellcrank 98 is pivotally attached at a fixed pivot 102 to a frame 104 whereby movement of the first arm 96 of the bellcrank 98 causes the second arm 100 of the bellcrank 98 to move via rotation about the fixed pivot 102.

The aforementioned second linking means comprises a mouth 106 formed by the second arm 100 of the bellcrank 98. The member 82 is pivotally mounted via a fixed pivot 108, to pivot relative to the frame 104. The pivot 108 is spaced latitudinally from the mouth 106 formed in the second arm 100 of the bellcrank 98. The member 82 includes a first portion 110 which extends into contact with the mouth 106 in position to move responsive to movement of the mouth 106 which itself moves responsive to rotation of the bellcrank 98. A second portion 112 of the member 82 contacts the outer end 84 of the drain spool 70 to linearly move the drain spool 70 responsive to rotation of the bellcrank 98. Biasing means 114 are provided which act intermediate the frame 104 and the member 82 to bias the member 82 to maintain contact with the mouth 106 and with the outer end 84 of the drain spool 70. In the particular embodiment illustrated, the biasing means 114 includes a post 116 which proceeds generally perpendicularly from the frame 104, a headless bolt 118 held to the post 116 by a nut 120, which is seen in FIG. 1, and a spring 122 biased between a flange 124 proceeding outwardly from the bolt 118 and the member 82. More particularly, the spring 122 exerts a force between the flange 124 and a part of the member 82 generally opposite the first portion 110 thereof.

A handle 126 can be made to extend, generally linearly, from the first arm 96 of the bellcrank 98 whereby the handle 126 allows shifting of the control spool 88 into any desired one of the Raise, Neutral, Lower and Float positions. It should be noted that in the particular embodiment illustrated in the Figures, the Raise and Neutral positions should be directly adjacent one another and the Lower and Float positions should be directly adjacent one another so as to allow shifting of the drain valve 64 to allow draining therethrough in the Lower and Float positions and to block draining therethrough in the Neutral and Raise positions. It should also be noted that the contact between the outer end 84 of the drain spool 70 and the second portion 112 of the member 82 must be simple touching contact and that the drain spool 70 cannot be made unitary with the second portion 112 of the member 82 because some relative rotation takes place therebetween as the bellcrank 98 and the member 82 rotate. It should further be noted that the spring 122 assures that the member 82 will return to position when the bellcrank 98 is rotated, for example, from the Lower to the Neutral position.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The embodiments of the invention in which an exclusive property or privilege is claimed are defined as follows:

1. In a hydraulic motor and control system therefor which comprises fluid source means for delivering fluid from sump means via first conduit means to control valve means having a float position wherein a first end of said motor is in flow communication with a second end thereof and with said sump means; a first position for applying fluid from said fluid source means to power said motor in a first direction by delivering said fluid to said first end thereof via second conduit means; and a second position in which said motor means moves in a second direction; sump conduit means communicating said control valve means with said sump means; and check valve means in said second conduit means allowing fluid flow therethrough to said first end of said motor and normally blocking reverse flow therethrough, said check valve means including control chamber means which when blocked from said sump means maintains said reverse flow blocking and when in flow communication with said sump means permits said reverse flow;

drain conduit means connecting said control chamber means with said sump means; an improvement comprising:

drain valve means in said drain conduit means having a first position communicating said drain conduit means to said sump means and a second position blocking communicating of said drain conduit means to said sump means;

means biasing said drain valve means into said first position thereof;

bellcrank means linked by first linking means at a first arm thereof to said control valve means, linked via second linking means at a second arm thereof to said drain valve means and pivoted to frame means intermediate said first and second arms thereof, said second linking means comprises: a mouth formed by said second arm of said bellcrank means; a member pivotally mounted to said frame means at an area thereof spaced latitudinally from said mouth, a first portion of said member extending into contact with said mouth in position to move responsive to movement of said mouth responsive to rotation of said bellcrank means, a second portion of said member contacting said drain valve means to overcome said biasing means and shift said drain valve means into said second position thereof responsive to rotation of said bellcrank means; and biasing means acting intermediate said frame means and said member to bias said member to maintain contact with said mouth and with said drain valve means.

2. An improvement as in claim 1, wherein said motor is a double acting motor and in said second position said control valve means applies fluid from said fluid supply source means to power said motor in said second direction by delivering said fluid to a second end thereof via third conduit means.

3. An improvement as in claim 1, wherein said control valve means includes a neutral position.

4. An improvement as in claim 3, wherein said control valve means comprises:

a control valve body and a control spool movable linearly into and out of said control valve body, the positioning of said control spool providing as said neutral position, a mode in which said second and third conduit means are isolated thereby from said sump means and said first conduit means communicates thereby with said sump means, as said float position a mode in which said first, second and third conduit means communicate thereby with said sump means, as said first position a raise mode in which said third conduit means communicates thereby with said sump means and said first conduit means communicates thereby with said second conduit means and as said second position a lower mode in which said second conduit means communicates thereby with said sump means and said first conduit means communicates thereby with said third conduit means.

5. An improvement as in claim 1, wherein said first linking means of said first arm of said bellcrank means to said control valve means comprises a link therebetween pivotally attached to each of said first arm of said bellcrank means and said control valve means.

6. In a hydraulic motor and control system therefor which comprises fluid source means for delivering fluid from sump means via first conduit means to control valve means having a float position wherein a first end of said motor is in flow communication with a second end thereof and with said sump means, a first position for applying fluid from said fluid source means to power said motor in a first direction by delivering said fluid to said first end thereof via second conduit means, a second position in which said motor moves in a second direction and a neutral position; an improvement comprising;

check valve means in said second conduit means allowing fluid flow therethrough to said first end of said motor and normally blocking fluid flow therethrough from said first end of said motor to said control valve means, said check valve means including piston means slidably fitting within said bore means, biasing means biasing a first end of said piston means against said seat means, control chamber means communicating with a second end of said piston means, flow restricting means communicating said first end of said motor with said control chamber means and substantially full flow means communicating said first end of said motor with said bore means to act against said first end of said piston means;

drain conduit means connecting said control chamber means with said sump means;

drain means in said drain conduit means having a first position communicating said drain conduit means to said sump means and a second position blocking communication of said drain conduit means to said sump means;

mechanically actuated means for opening said check valve means to allow fluid flow therethrough from said first end of said motor to said control valve means responsive to operation of said control valve means in said float position and in said second position, said opening means comprising mechanical means moving responsive to shifting of said control valve means to shift said drain means into said first position thereof when said control valve means is in said float and second positions and into said second position thereof when said control valve means is in said first position;

wherein said control valve means comprises a control valve body and a control spool movable linearly into and out of said control valve body, the positioning of said control spool providing as said neutral position, a mode in which said second and third conduit means are isolated thereby from said sump means and said first conduit means communicates thereby with said sump means, as said float position a mode in which said first, second and third conduit means communicate thereby with said sump means, as said first position a raise mode in which said third conduit means communicates thereby with said sump means and said first conduit means communicates thereby with said second conduit means and as said second position a lower mode in which said second conduit means communicates thereby with said sump means and said first conduit means communicates thereby with said third conduit means;

wherein said mechanical means comprises bellcrank means linked by first linking means at a first arm thereof to said control spool, linked via second linking means at a second arm thereof to a drain spool of said drain means and pivoted to frame means intermediate said first and second arms thereof, said first linking means comprising a link pivotally attached between said first arm of said bellcrank means and said control spool;

means biasing said drain spool towards said first position thereof, said mechanical means exerting a force upon said drain spool in opposition to said biasing means sufficient to shift said drain spool into said second position thereof;

wherein said second linking means comprises: a mouth formed by said second arm of said bellcrank means; a member pivotally mounted to said frame means at an area thereof spaced latitudinally from said mouth, a first portion of said member extending into contact with said mouth in position to move responsive to movement of said mouth responsive to rotation of said bellcrank means, a second portion of said member contacting a first end of said drain spool to linearly move said drain spool responsive to rotation of said bellcrank means; and biasing means acting intermediate said frame means and said member to bias said member to maintain contact with said mouth and said first end of said drain spool.

7. An improvement as in claim 6, wherein said drain valve interconnection between said entry and exit ports is by an undercut in said drain spool and said drain valve blocking between said entry and exit ports is by a land of said drain spool.

* * * * *